US006560801B2

(12) United States Patent
Clarke et al.

(10) Patent No.: US 6,560,801 B2
(45) Date of Patent: May 13, 2003

(54) LAYERED TEXTILE PRODUCT AND METHOD OF MANUFACTURING PRODUCT

(75) Inventors: James G. Clarke, Fairview, NC (US); Michael S. Walker, Forest City, NC (US)

(73) Assignee: The Manual Woodworkers and Weavers, Inc., Hendersonville, NC (US)

( * ) Notice: Subject to any disclaimer, the term of this patent is extended or adjusted under 35 U.S.C. 154(b) by 92 days.

(21) Appl. No.: 09/799,166

(22) Filed: Mar. 5, 2001

(65) Prior Publication Data

US 2002/0124315 A1 Sep. 12, 2002

(51) Int. Cl.[7] ..... A47G 9/02
(52) U.S. Cl. ..... 5/636; 5/490
(58) Field of Search ..... 5/636, 490, 502, 5/500; 112/475.22, 103, 439, 420

(56) References Cited

U.S. PATENT DOCUMENTS 3,974,531 A * 8/1976 Van Pelt ..... 5/490
4,719,656 A * 1/1988 Godinet ..... 5/690
4,763,604 A * 8/1988 Meekins ..... 119/28.5
5,603,647 A 2/1997 Van Adrichem et al.
6,152,187 A 11/2000 Lindblom
6,170,860 B1 1/2001 Denz et al.
6,438,778 B1 * 8/2002 Johnson ..... 5/636

FOREIGN PATENT DOCUMENTS

GB 2082057 * 3/1982 ..... B68G/11/00

OTHER PUBLICATIONS

"How to make a pillow" web page, Feb. 2001.*
"Make a pillow," Kids Domain website, Nov. 1999.*

* cited by examiner

*Primary Examiner*—Frederick L. Lagman
(74) *Attorney, Agent, or Firm*—Dority & Manning

(57) ABSTRACT

A two-layered textile product and method of making the product is disclosed. The product comprises a first layer, and a second layer. A woven seam connects the first layer to the second layer to form a textile structure. The textile structure includes an inner surface and an outer surface, with the woven seam arranged in a predetermined pattern to form a margin that corresponds to the exterior dimensions of the finished product. A seam opening of a predetermined length is provided so that the textile structure is capable of inversion by pulling the inner surface fabric through the seam opening so that the inner surface is then exposed to form the outer margin of a two-layered textile product. The product may be stuffed to form a decorative pillow or like product. Decorative fabrics and tapestries may be used in the finished product.

16 Claims, 7 Drawing Sheets

LAYERED TEXTILE PRODUCT AND METHOD OF MANUFACTURING PRODUCT

FIELD OF THE INVENTION

The invention is directed to woven textile fabrics, and in particular, two layered fabrics that may be woven together to form textile articles.

BACKGROUND OF THE INVENTION

In the manufacture of textile materials, a weaving machine may be used to weave fabrics to each other. Bobbin shuttles are employed for drawing a thread of the weft through sheds formed by warp threads. In many cases, woven material is made into tubular or other enclosed shapes by seaming free ends of the warp threads. In the past, this has been performed in a sewing department, either automatically or manually. Pillows are manufactured in this way. Fabrics of all types, including tapestries which form an image on the fabric, also are commonly manufactured in this way.

In the manufacture of stuffed or decorative pillows, for example, it has been common to provide two fabrics, one for the first side of the pillow, and one for the second side. Often, the second side is decorative, providing an image in many instances. Sometimes these fabrics are woven or tufted. In most cases, however, the fabrics are sent from a weaving facility to a sewing area or other sewing facility in order to sew the two fabric portions together (i.e. the first side and the second side) all around the periphery or margin of the pillow to form an enclosed pillow case. The enclosed pillow case is then stuffed to form a pillow.

Labor costs are a significant factor in manufacturing textile based items such as pillows, place mats, table runners, wall hangings, bell pulls, and the like. It is always desirable to provide a method of manufacturing an article without requiring these sort of manual sewing steps. Any time a laborer is required to provide even a moment of attention to a textile product, it drives up the overall cost of the process, and the resulting product produced by that process.

What is needed in the industry is a method of making a two layered textile product by weaving the two layers together, without requiring a lengthy sewing step to join the two layers to each other. A method that requires no sewing, or only a minimum amount of sewing, would be highly desirable.

SUMMARY OF THE INVENTION

A two layered textile product is provided in the practice of the invention. The product comprises a first layer and a second layer. Furthermore, a woven seam connects the first layer to the second layer to form a textile structure. The textile structure has an inner surface and an outer surface, the woven seam being arranged in a predetermined pattern to form a margin corresponding to the exterior dimensions of finished product. A seam opening is also provided, wherein the textile structure is capable of inversion by pulling the inner surface through the seam opening so that the inner surface may be exposed to form the margin of a two layered textile product.

In the case of a pillow or stuffed product, fill then can be inserted inside the textile structure (or pillow case) to form a soft padded product. Then, the case may be closed by sewing, heat sealing, or stitching to form a finished product.

In some applications of the invention, a two layered textile product is provided in which the second layer is a decorative tapestry. The product may be a pillow or other stuffed soft decorative item.

In some embodiments of the invention, the seam opening is configured to be joined in a relatively simple manner by sewing, bonding, fastening, zipping (i.e. using a zipper) or by any other means that is capable of reliably enclosing the open margin of the shaped product.

One embodiment of the invention is directed to a pillow formed from a two-layered textile structure woven upon a single loom. The two layered textile structure comprises a first backing layer, and a second decorative layer. Furthermore, a woven seam connecting the first backing layer to the second decorative layer forms a textile structure, the textile structure having an inner surface and an outer surface.

Furthermore, the woven seam defines a margin, with a seam opening in the woven seam, wherein the textile structure is capable of inversion by pulling the inner surface through the seam opening so that the inner surface of the textile structure may be exposed to form the exterior of a pillow. The pillow also may comprise a second decorative layer which is a tapestry. In some embodiments, the pillow of the first backing layer is a decorative tapestry.

In other applications of the invention, a method of forming a pillow case by weaving two separate fabric layers upon a single loom is provided. The method comprises the steps of providing first and second fabric layers and then weaving the first and second fabric layers together upon a loom. Then, a seam is formed having a margin of a predetermined desired shape, the margin forming the partial outline of a pillow case. Finally, a method of providing a seam opening is presented, wherein the first and second layers are not attached to each other at the seam opening. The method also may include an additional step of inverting the pillow case by pulling the first and second fabric layers through the seam opening, and then stuffing the pillow. Finally, it is necessary to seal the seam opening by snaps, buttons, velcro, heat sealing, sewing, or even employing a zipper.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
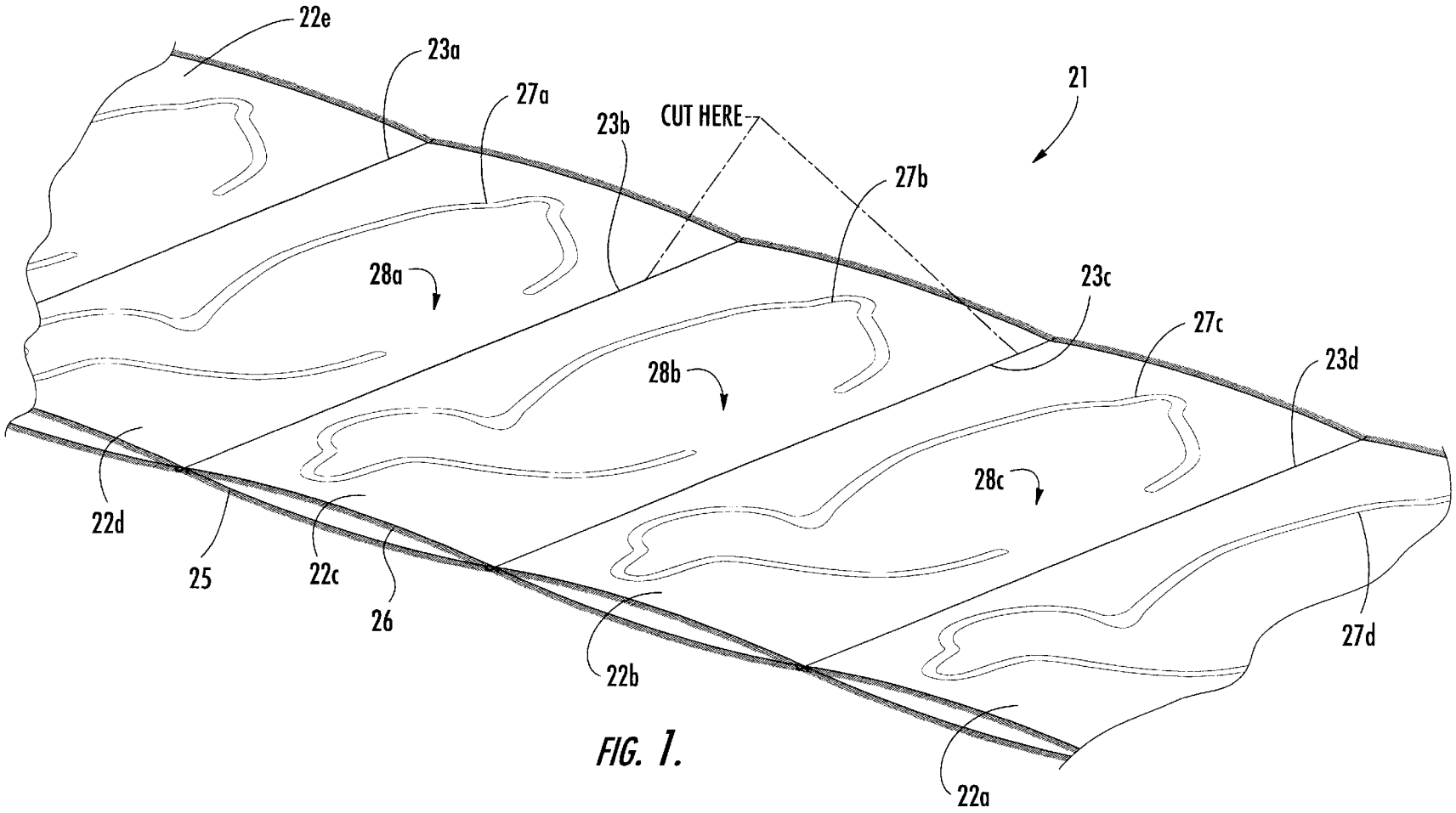
FIG. 1 is a perspective view of the two layers of fabric having multiple products in series that are joined by weaving/stitching according to the invention.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

One advantage of the product or article made according to the method of the invention is that the fabric backing may be woven on a loom at the same time that the fabric front (i.e. in some cases the tapestry front) is woven. Thus, the invention provides a single step concept of simultaneously weaving both the front and the backing fabric on the same loom at the same time. This procedure is in contrast to traditional prior art processes, which typically required that the front decorative fabric be woven one loom, with the backing fabric being woven another loom. By weaving the fabrics together on the same loom, it is possible to provide substantial labor savings and produce a product in less time. Furthermore, the margins around the exterior of the product, when completed, are superior when the fabrics are woven together as opposed to prior art methods of sewing the entire margin around the exterior of the pillow.

In the practice of the invention, the product is woven "in-side-out" so that the woven seam around the outside of the product will end up being on the inside of the finished product when completed. Thus, in many applications of the invention, the woven and finished image or tapestry will be on the side of the decorative fabric that is face down, or against the backing fabric when produced. Only after the product is inverted, does the decorative image appear. This occurs when the fabric is turned "right-side-out".

A small non-woven opening in the fabric, the seam opening, is the location in which the pillow making operator can insert his or her hand to turn the product "right-side-out". The product may be inverted either automatically, or manually, depending upon the geometry of the finished pillow. The seam opening may be used to facilitate the pillow making operator to insert the inside stuffing of the pillow.

In the application of the invention, this self-backed tapestry may be used to create other non-stuffed products that require a tapestry front and a fabric backing. Some examples of products that could be produced pursuant to the invention include place mats, table runners, wall hangings, bell pulls, and others.

Turning to FIG. 1, a fabric run 21 is shown wherein a first layer 25 and a second layer 26 are superimposed on top of each other, and attached to each other by way of a woven seam 27*a*, 27*b*, 27*c*, 27*d*, and so forth along the length of the continuous fabric. Each separate article or product is separated by cut lines 23*a–d*, as shown in FIG. 1. These cut lines 23*a–d* provide the location at which the continuous fabric run 21 may be separated into panels 22*a–e*. The woven seams such as woven seam 27*a* are continuous around their margin except for a seam opening 28*a* (28*b* and 28*c* in other panels), at which the first layer 25 and second layer 26 are not attached to each other. The seam openings, such as seam opening 28*a*, provide an important aspect of the invention which permits the individual panels 22*a–d* once separated, to be inverted to form a finished product.

Figure 2:
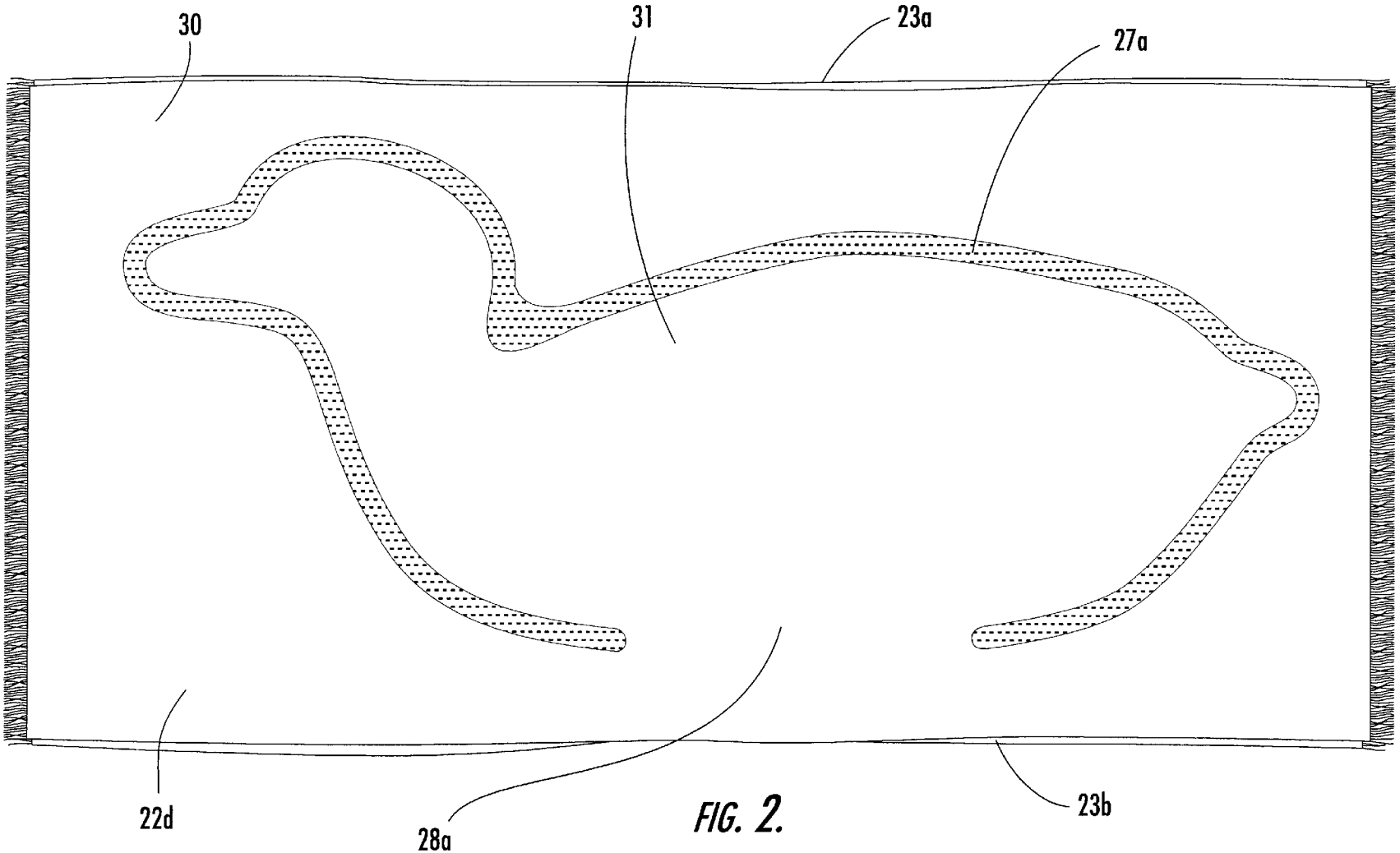
FIG. 2 shows a separated portion of fabric containing one product, with a seam opening along the margin of the outline.

FIG. 2 shows a separated portion or panel 22*d* of fabric containing enough material to make one end product, with a seam opening 28*a* along the lower margin of the outline of the figure or scene outlined (in this case a duck). The back side 31 of a decorative tapestry is shown, which forms the second layer 30 of the panel 22*d*. The woven seam 27*a* forms the outline of the scene, and cut line 23*b* is the point at which this panel 22*d* is separated from the successive panel 22*c* (shown in FIG. 1). Likewise, cut line 23*a* at the upper margin of the panel 22*d* is the separation point from the panel 22*e* shown in FIG. 1.

Figure 3:
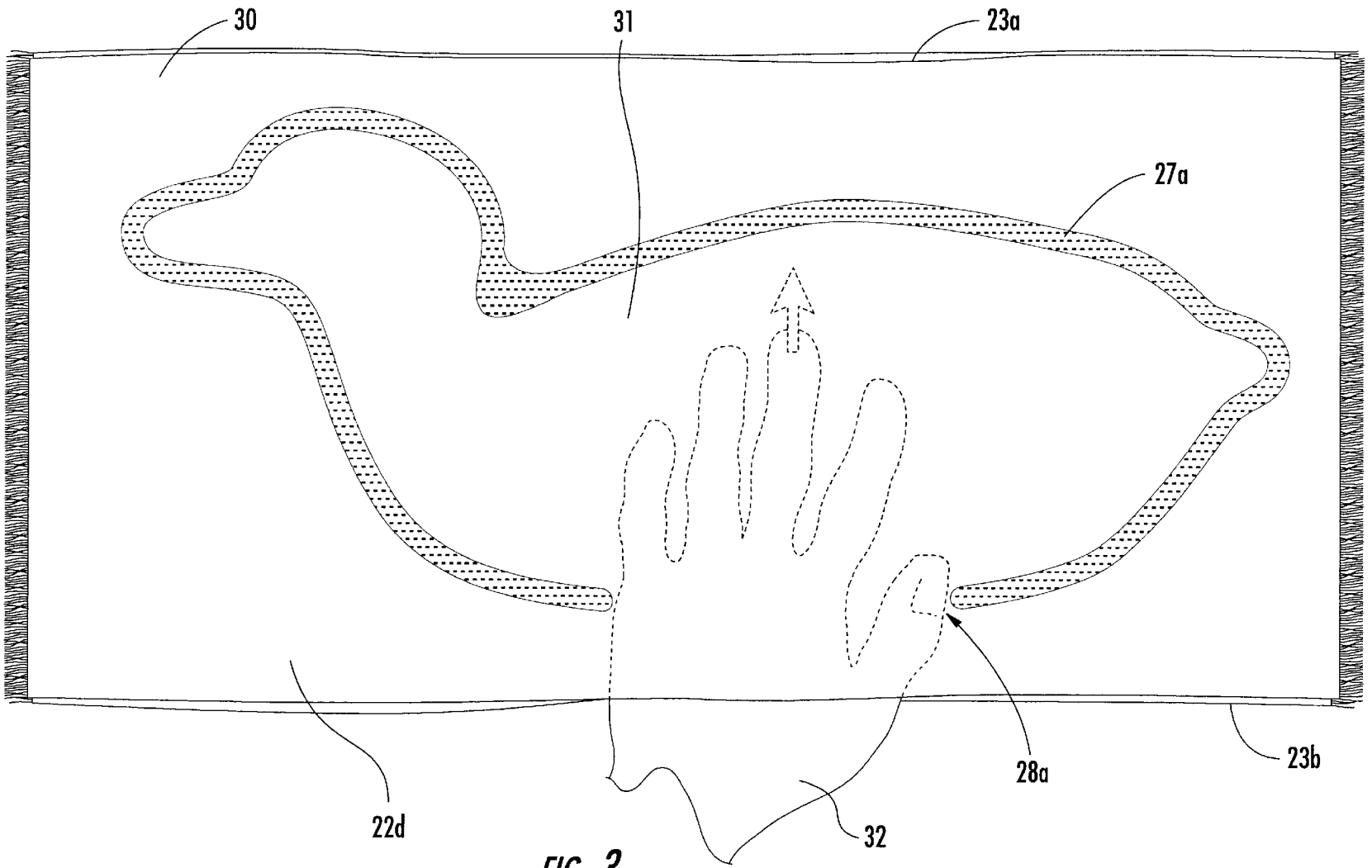
FIG. 3 depicts the initial step of inserting a hand or instrument into the two layered structure to begin the inversion process.

FIG. 3 shows a first step in the inversion process in which a human hand 32 is shown reaching in along the cut line 23*b* into the inner surface 34 (inner surface 34 shown in FIG. 4) to enable the pulling of the fabric through the seam opening 28*a*. In some cases, the product could be inverted by machine, or by any other pulling device or mechanical means that is capable of contacting the inner surface 34 of the fabric and pulling it through the seam opening 28*a*. In fact, even pneumatic means could be used to "blow" the product, thereby inverting it. The invention is not limited to the method or technique used in inverting the product, and essentially any method or means that is capable of doing so would be within the scope and spirit of the invention.

FIG. 3 also shows the second layer 30 of panel 22*d* which also contains the back side 31 of a decorative tapestry. Woven seam 27*a* is shown outlining a duck figure, and the cut lines 23*a* and 23*b* are shown at the top and bottom of FIG. 3, respectively.

Figure 4:
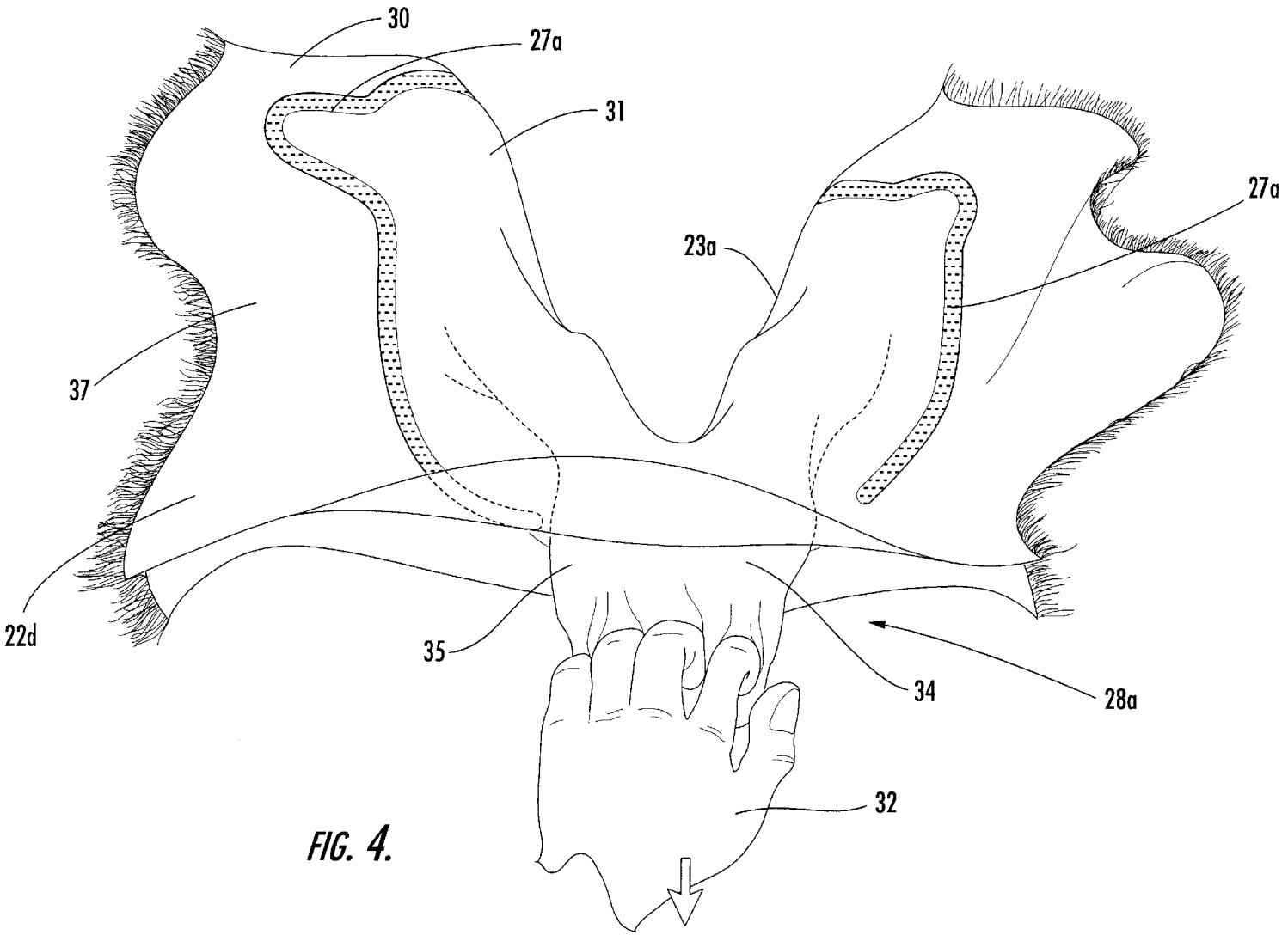
FIG. 4 shows the article being pulled and inverted.
Figure 5:
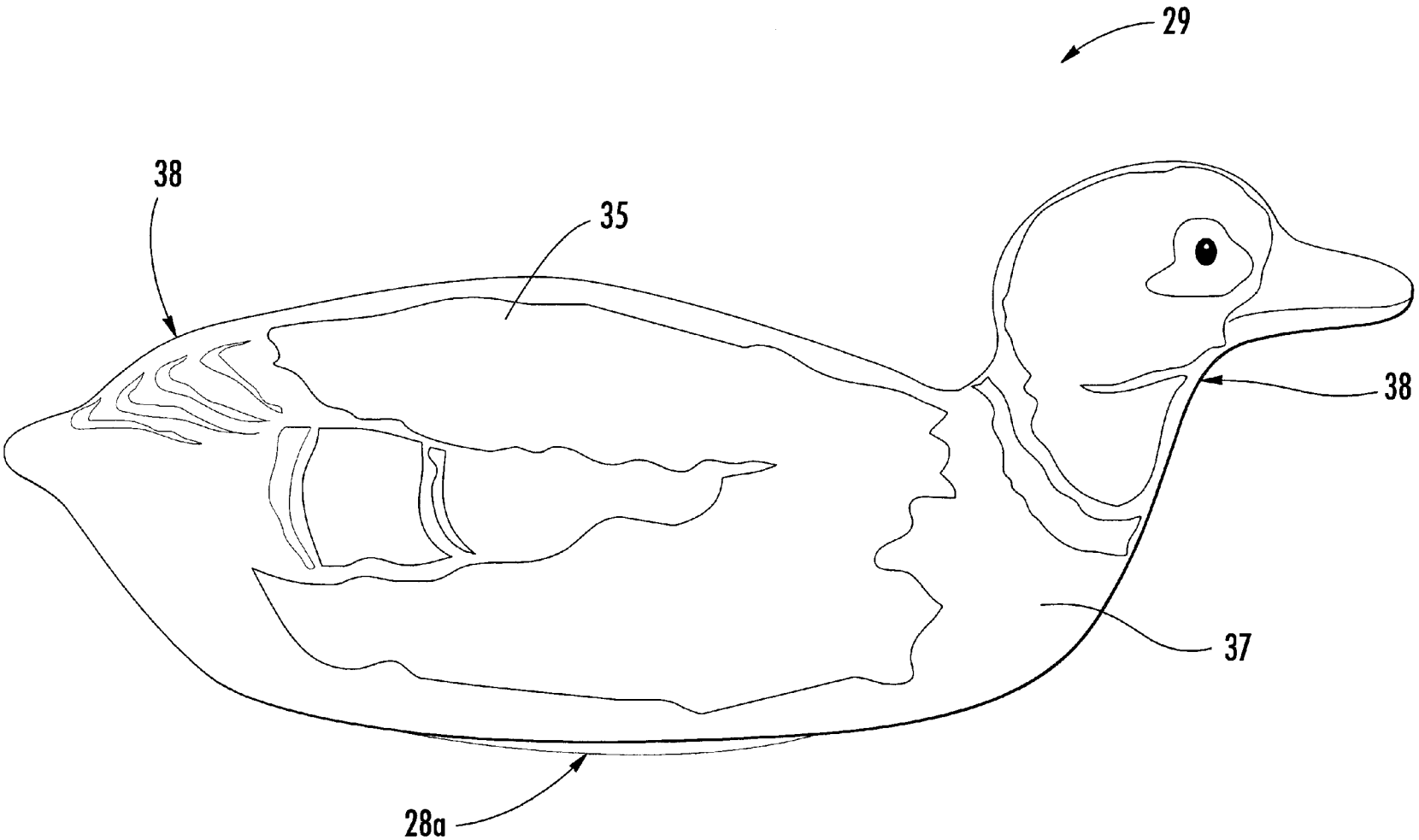
FIG. 5 shows a flat pillow case that is ready to receive stuffing to form a pillow.
Figure 6:
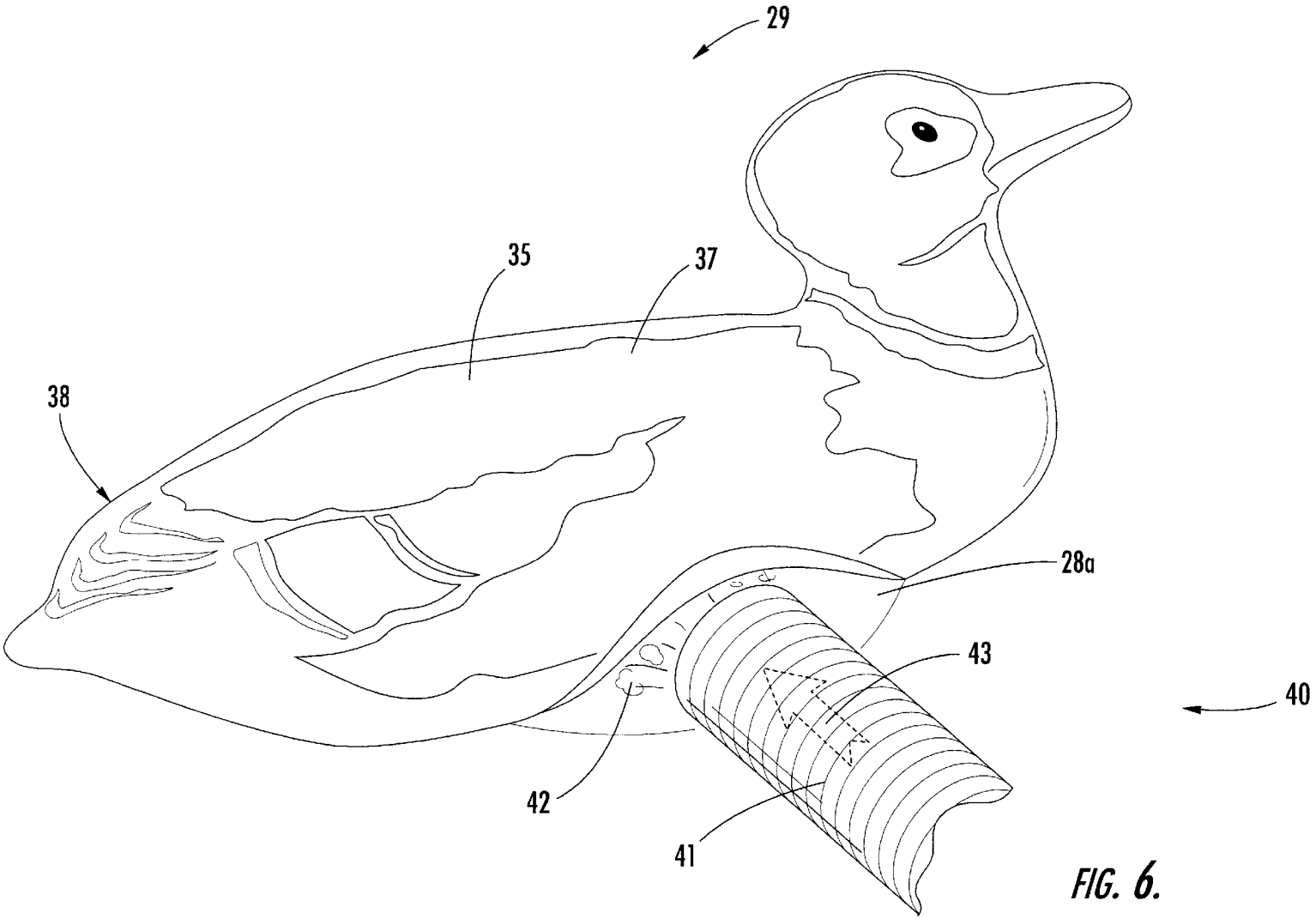
FIG. 6 shows a pillow being stuffed.

FIG. 4 shows the partial inversion of the panel 22*d* revealing for the first time the inner surface 34 of the product by pulling with hand 32 the fabric on the inner surface 34 to reveal the front side 35 of the decorative tapestry. Cut line 23*a* is pulled down and eventually through the seam opening 28*a* while the back side 31 of the decorative tapestry is pulled through and inverted to reveal the front side 35 of the decorative tapestry. The woven seam 27*a*, once pulled through the seam opening 28*a*, becomes the outer margin of the product as seen in outer margin 38 as seen in FIGS. 5–6. A textile structure 37 is comprised generally of both layers of fabric, which are weaved together.

The outer surface 29 of the product is revealed upon inversion, as shown in FIG. 5. The margin 38 around the periphery of the textile structure 37 is seen. Furthermore, the front side 35 of the decorative tapestry is seen, and the seam opening 28*a* is shown on the underside, near the bottom of FIG. 5.

In FIG. 6, a stuffing step 40 is shown in which the outer surface 29 which has now been revealed is stuffed with batting or fill material 42 using any means. One means, which is shown in FIG. 6, shows a hose 41 which actually blows the fill material 42 into the textile structure 37. In other means, it would be possible to manually place fill material 42 into the textile structure 37, or to automatically drop it or inject it using means other than hose 41. In one embodiment, the invention is directed to a textile structure that is stuffed into a pillow, but the invention is not limited to any particular method or means for stuffing the textile structure 37 in order to form the pillow. The blow direction 43 shows the path way of the batting or fill material 42 which is injected into the textile structure 37.

Figure 7:
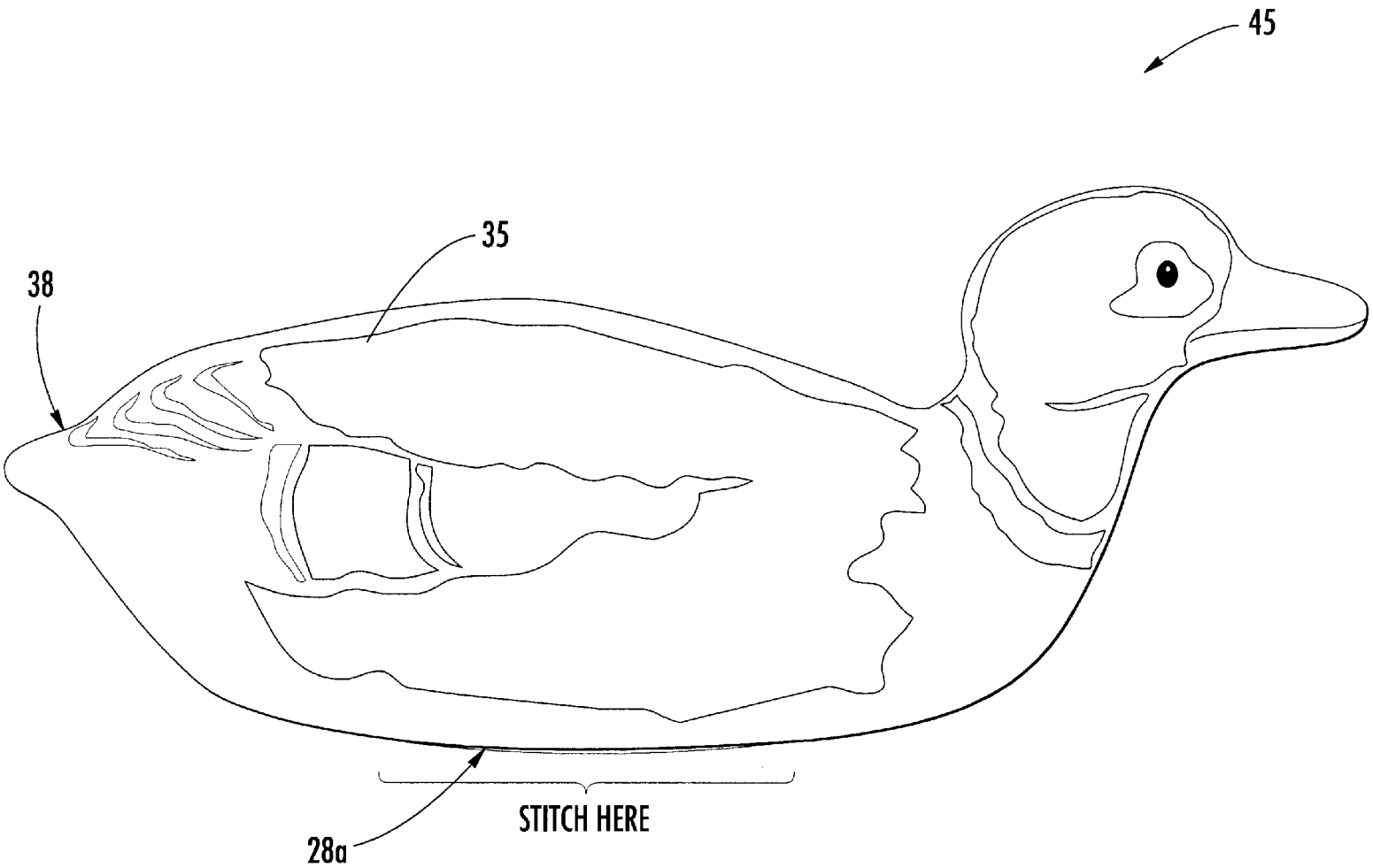
FIG. 7 is a completed pillow with a closed stitched seam opening along the lower margin.

In FIG. 7, a stuffed product or pillow 45 is shown as a final product with a finished article seen in FIG. 7. Obviously, the invention is not limited by the style or type of tapestry, as almost any object, animal, landscape, person, place, or thing could be subject of the product. A duck is but one such example. The front side 35 of a decorative tapestry provides an attractive feature for one side of the duck, and margin 38 around the edge of the duck is clean and neat, since the weave puts a highly finished margin that is generally more attractive and well finished than prior art methods of sewing the entire margin of the pillow 45. Furthermore, the seam opening 28*a* near the bottom portion of the pillow 45 is closed using an automatic sewing step or other means, which may include any manner of bonding the structure together to prevent the fill material 42 from escaping the pillow 45. This bonding can be accomplished by sewing, heat sealing, fastening, zipping, buttoning, or by any other means that is capable of reliably attaching the first layer 25 to the second layer 26 of the finished pillow 45.

The batting or fill material 42 of the invention may be comprised of polyester, cotton, or other suitable durable material.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A two layered textile product comprising:

(a) a first layer, (b) a second layer, (c) a woven seam connecting the first layer to the second layer to form a textile structure, the textile structure having an inner surface and an outer surface, the woven seam arranged in a predetermined pattern to form a margin corresponding to the exterior dimensions of a finished product, and (d) a seam opening, wherein the textile structure is capable of inversion by pulling the inner surface through the seam opening so that the inner surface may be exposed, whereby the woven seam is configured to form the margin of the finished product.

2. The product of claim 1 in which the product is filled to form a stuffed product.

3. The product of claim 1 in which the second layer is a decorative tapestry.

4. The product of claim 2 in which the stuffed product is a pillow.

5. The product of claim 2 in which the seam opening is configured to be sewn, facilitating completion of the margin of the shaped product.

6. A pillow formed from a two-layered textile structure woven upon a single loom, comprising:

(a) a first backing layer, (b) a second decorative layer, (c) a woven seam connecting the first backing layer to the second decorative layer to form a textile structure, the textile structure having an inner surface and an outer surface, the woven seam defining a margin, (d) a seam opening in the woven seam, wherein the textile structure is capable of inversion by pulling the inner surface through the seam opening so that the inner surface of the textile structure may be exposed to form the exterior of a pillow.

7. The pillow of claim 6 in which the second decorative layer is a tapestry.

8. The pillow of claim 7 in which the first backing layer is a decorative tapestry.

9. A method of forming a pillow case by weaving two separate fabric layers upon a single loom comprising the steps of:

(a) providing first and second fabric layers;

(b) weaving the first and second fabric layers together upon a loom;

(c) forming a woven seam in step (b) having a margin of a predetermined desired shape, the margin forming the partial outline of a pillow case; and (d) providing a seam opening, wherein the first and second layers are not woven to each other at the seam opening.

10. The method of claim 9 comprising the additional step of:

(e) inverting the pillow case by pulling the first and second fabric layers through the seam opening.

11. The method of claim 10 comprising the additional step of:

(f) stuffing the pillow case with fill material.

12. The method of claim 11 comprising the additional step of:

(g) sewing the seam opening to enclose the margin of the pillow.

13. A pillow made by the process of:

(a) providing first and second fabric layers;

(b) weaving the first and second fabric layers together upon a loom;

(c) forming a woven seam having a margin of a predetermined and desired shape, the margin forming a partial outline of a pillow case; and (d) providing a seam opening, wherein the first and second layers are not woven to each other at the seam opening;

(e) inverting the pillow case by pulling the fabric layers through the seam opening;

(f) stuffing the pillow case; and (g) enclosing the seam opening to form a completed margin of the pillow.

14. The pillow of claim 13 in which the second fabric layer comprises a decorative fabric.

15. The pillow of claim 14 in which the first fabric layer comprises a decorative fabric.

16. The pillow of claim 14 in which the seam opening is closed by sewing.

* * * * *